US006883689B2

(12) United States Patent
Odet

(10) Patent No.: US 6,883,689 B2
(45) Date of Patent: Apr. 26, 2005

(54) METHOD AND DEVICE FOR CLOSING A CONTAINER AND CONTAINER PROVIDED WITH SAME

(75) Inventor: Philippe Odet, Saint-Georges-de-Reneins (FR)

(73) Assignee: Tetra Laval Holding & Finance S.A., Pully (CH)

( * ) Notice: Subject to any disclaimer, the term of this patent is extended or adjusted under 35 U.S.C. 154(b) by 129 days.

(21) Appl. No.: 10/203,187

(22) PCT Filed: Mar. 8, 2001

(86) PCT No.: PCT/FR01/00701

§ 371 (c)(1),
(2), (4) Date: Aug. 7, 2002

(87) PCT Pub. No.: WO01/66430

PCT Pub. Date: Sep. 13, 2001

(65) Prior Publication Data

US 2003/0010781 A1 Jan. 16, 2003

(30) Foreign Application Priority Data

Mar. 9, 2000 (FR) ..... 00 03041

(51) Int. Cl.[7] ..... B65D 47/10

(52) U.S. Cl. ..... 222/541.9; 222/541.1; 220/258.2; 220/258.3

(58) Field of Search ..... 222/541.6, 541.9, 222/541.4–541.5, 541.1–541.2, 522–523, 83; 220/258.1–258.5; 215/253, 255, 349

(56) References Cited

U.S. PATENT DOCUMENTS

| | | | | | |
|---|---|---|---|---|---|
| 3,149,763 | A | * | 9/1964 | Exton | 222/541.2 |
| 3,207,375 | A | * | 9/1965 | Bereziat et al. | 222/81 |
| 3,227,317 | A | * | 1/1966 | Bereziat et al. | 222/83 |
| 4,094,460 | A | * | 6/1978 | Scanga et al. | 229/123.1 |
| RE29,850 | E | * | 11/1978 | Labarre | 222/541 |
| 4,136,819 | A | * | 1/1979 | Torita et al. | 235/431 |
| 4,359,169 | A | | 11/1982 | Helms | |
| 4,418,834 | A | * | 12/1983 | Helms et al. | 220/359.3 |
| 4,735,334 | A | * | 4/1988 | Abbott | 222/546 |
| 4,760,941 | A | * | 8/1988 | Salmon et al. | 222/153.07 |
| 5,184,746 | A | * | 2/1993 | Moore et al. | 220/258.2 |
| 5,927,549 | A | * | 7/1999 | Wood | 222/83 |
| 5,947,315 | A | * | 9/1999 | Valyi et al. | 220/258.1 |
| 6,574,848 | B1 | * | 6/2003 | Fujie et al. | 29/281.5 |

FOREIGN PATENT DOCUMENTS

| | | |
|---|---|---|
| WO | 9961337 | 12/1999 |

* cited by examiner

*Primary Examiner*—Frederick Nicolas
(74) *Attorney, Agent, or Firm*—Dowell & Dowell, P.C.

(57) ABSTRACT

A method and device for closing a container provided with a neck including a pourer and a cap and an element carried by the pourer and a sealing membrane carried by the pourer so as to interposed between the element and the neck. The element is secured to the membrane by sealing after the device is applied to the neck and the element forced to urge the membrane against the neck.

8 Claims, 4 Drawing Sheets

METHOD AND DEVICE FOR CLOSING A CONTAINER AND CONTAINER PROVIDED WITH SAME

BACKGROUND OF THE INVENTION

1. Field of the Invention

The invention relates to a method and a device for closing a container provided with a neck and to a container equipped with such a device.

2. Description of the Related Art

It is known to make containers for liquid, such as milk bottles made of plastics material, for example high density polyethylene. In order to avoid drips of liquid during pouring from the neck of the container, it is known to equip this neck with a pourer forming a surface for flow of the liquid.

It is also known to close the neck of a bottle, equipped with a pourer or not, by means of a closure made of a sheet of aluminium, this closure generally being sealed on this neck. The removal of such a closure is generally not easy and a user not used to this type of closure does not understand intuitively. This results in false manipulations. In addition, even if he/she is used to this type of closure, it happens that the user does not manage to remove the closure completely, shreds of closure remaining in place on the edges of the neck or of the pourer, which creates an obstacle to the flow of the milk and renders the flow irregular. In addition, such shreds of closure hinder subsequent recycling and revalorisation of the bottle, which cannot be considered as a homogeneous object made of plastics material.

U.S. Pat. No. 4,815,618 teaches sticking a disc on a circular closure wedged, by its peripheral zone, between a neck and an annular part of the stopper. To remove the closure, it is necessary to break bridges connecting this disc to this annular part and to tear the closure whose peripheral edge remains jammed between the neck and the annular part. This requires a considerable effort likely to induce a rupture of the traction ring of the disc and/or to provoke projections. In addition, the bearing of the disc on the closure depends on the manufacturing tolerances of the stopper and of the neck of the container and it could not be excluded that the closure be incurved at the level of the disc, hence a risk of imperfect seal.

SUMMARY OF THE INVENTION

It is a more particular object of the invention to overcome these drawbacks by proposing a method for closing a container as described hereinabove which consists:

when a stopper is fixed on the neck or the pourer of the container, in pressing towards the neck an element previously attached to the pourer, with interposed between this element and this neck, a tight sealed membrane closure of the neck; and in securing this element to this membrane by sealing.

Thanks to the method of the invention, the positioning of the stopper induces a firm bearing or application of the afore-mentioned element on the membrane closure, which is used to advantage for securing them by sealing, this element then facilitating extraction of the membrane closure when the product contained in the container is to be used.

According to a first advantageous aspect of the invention, the method consists in sealing the element and the membrane closure firmly and in sealing the membrane closure and the neck in non-definitive manner. Thanks to this aspect of the invention, the membrane closure remains fast with the manoeuvring element when the latter is displaced with respect to the neck, which allows a complete tear of the membrane closure with respect to the neck.

The invention also relates to a closure device for carrying out the method as described hereinabove and, more specifically, to a closure device which comprises:

an element adapted to be pressed towards the neck of the container due to the fixation of a stopper on the neck or on the pourer and a membrane closure for this neck designed to be interposed between this element and this neck and to be sealed to this element and to this neck.

According to advantageous but non-obligatory aspects of the invention, the device incorporates one or more of the following characteristics:

The afore-mentioned element is fast with a ring for gripping allowing it to be torn with respect to the neck.

The afore-mentioned element comprises a substantially planar surface, in the form of a ring or disc, for bearing against the membrane closure.

The membrane closure is adapted to be firmly sealed to the afore-mentioned element and to be removably sealed to the neck.

The membrane closure comprises a core made of a complex based on aluminium and coated, on a first face, with a peel-off varnish and, on a second face, with a film based on polyethylene.

The element is adapted to be maintained at a distance from the membrane closure by the pourer before fixation of the stopper on the pourer.

The element is formed in one piece with the pourer to which it is connected, before the fixation of the stopper, by at least one breakable bridge, this bridge making it possible to maintain the element at a distance from the membrane closure.

The stopper comprises a part adapted to exert on the afore-mentioned element an effort of thrust in the direction of the neck and of the membrane closure.

The pourer is equipped with a lip defining, with the afore-mentioned element, a chamber for pre-positioning of the membrane closure, this lip also participating in the tightness of the assembly between the pourer and the neck.

The invention also relates to a container for liquid, particularly a plastic bottle, equipped with a closure device as described hereinabove. Such a container is easier to manipulate than those of the state of the art, while its manufacture and cost price are economically satisfactory.

BRIEF DESCRIPTION OF THE DRAWINGS

The invention will be more readily understood and other advantages thereof will appear more clearly in the light of the following description of an embodiment of a closure device in accordance with its principle and of its method of implementation, given solely by way of example and made with reference to the accompanying drawings, in which.

DESCRIPTION OF THE PREFERRED EMBODIMENTS

Figure 1:
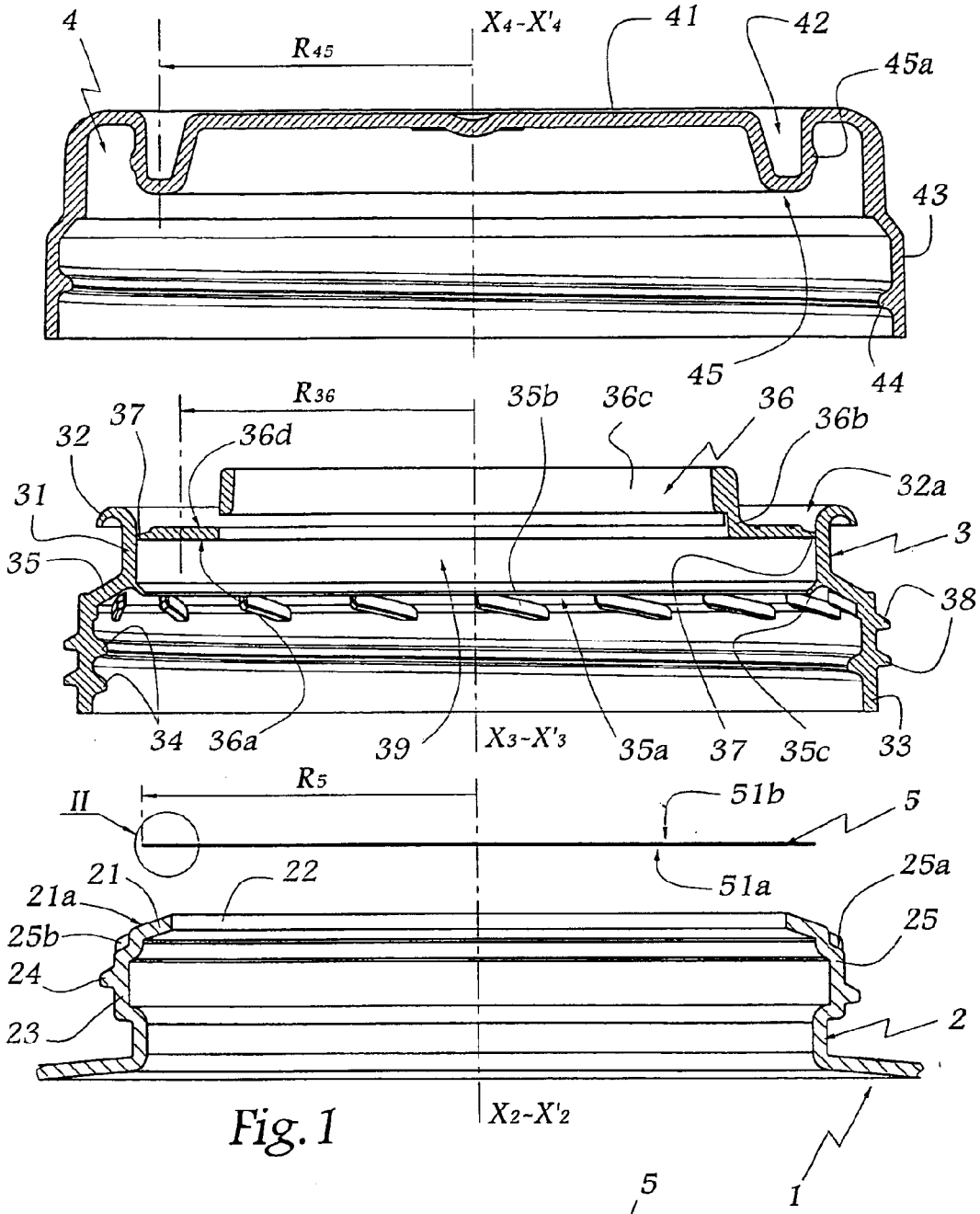
FIG. 1 is an exploded view of a closure device and of the neck of a bottle according to the invention.
Figure 2:
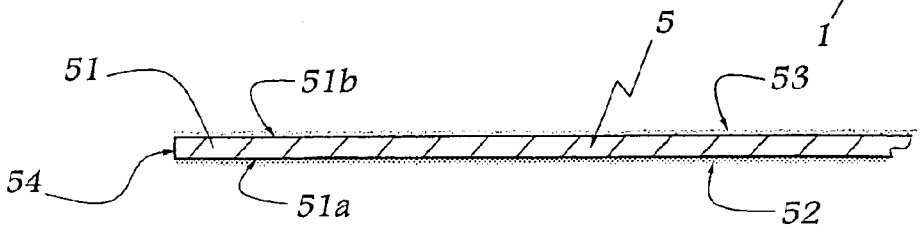
FIG. 2 is a view on a larger scale of detail II in FIG. 1.

The bottle 1 shown in the Figures is a bottle intended to contain milk, made by blowing a high density polyethylene parison. The cost of such a bottle is attractive, while it performs its function efficiently.

The neck 2 of this bottle is substantially cylindrical and $X_2$-$X'_2$ denotes its axis of symmetry. This neck has a curved generatrix and it forms a slightly truncated part 21 of which the inner end constitutes the edge 22 of the neck 2, part 21 extending opposite the edge 22 by a part 23 with curved generatrix outside which a thread 24 is formed.

The device of the invention also comprises a pourer 3 and a stopper or cap 4, respectively, made of low density polyethylene and a high or medium density polyethylene. Other materials may, of course, be used for molding the elements 2, 3 and 4, the material of the pourer advantageously remaining less rigid than those of the neck 2 and the stopper or cap 4.

The pourer 3 is cylindrical and symmetrical about an axis $X_3$-$X'_3$ merged with axis $X_2$-$X'_2$ when the pourer 3 is screwed on neck thanks to an inner thread 34 provided to cooperate with the thread 24. The pourer 3 comprises a part 31 with generatrix substantially rectilinear and parallel to axis $X_3$-$X'_3$ and of which the edge 32 opposite the body 11 of the bottle 1 is curved outwardly, with the result that it forms a surface 32*a* for flow of the milk towards the outside of the bottle 1.

The pourer 3 also comprises a second part 33 with generatrix substantially parallel to axis $X_3$-$X'_3$, parts 31 and 34 being joined by a truncated part 35 intended to abut against the outer surface 25*a* of a transition zone 25 between parts 21 and 23 of the neck 2.

On its face 35*a* provided to come into contact with the surface 25*a*, the part 35 is provided with ribs 35*b* intended to fit against complementary ribs 25*b* formed on the surface 25*a*, these ribs 25*b* and 35*b* being oriented so that they oppose an unscrewing of the pourer 3 when the latter has been screwed on the neck 2.

Figure 4:
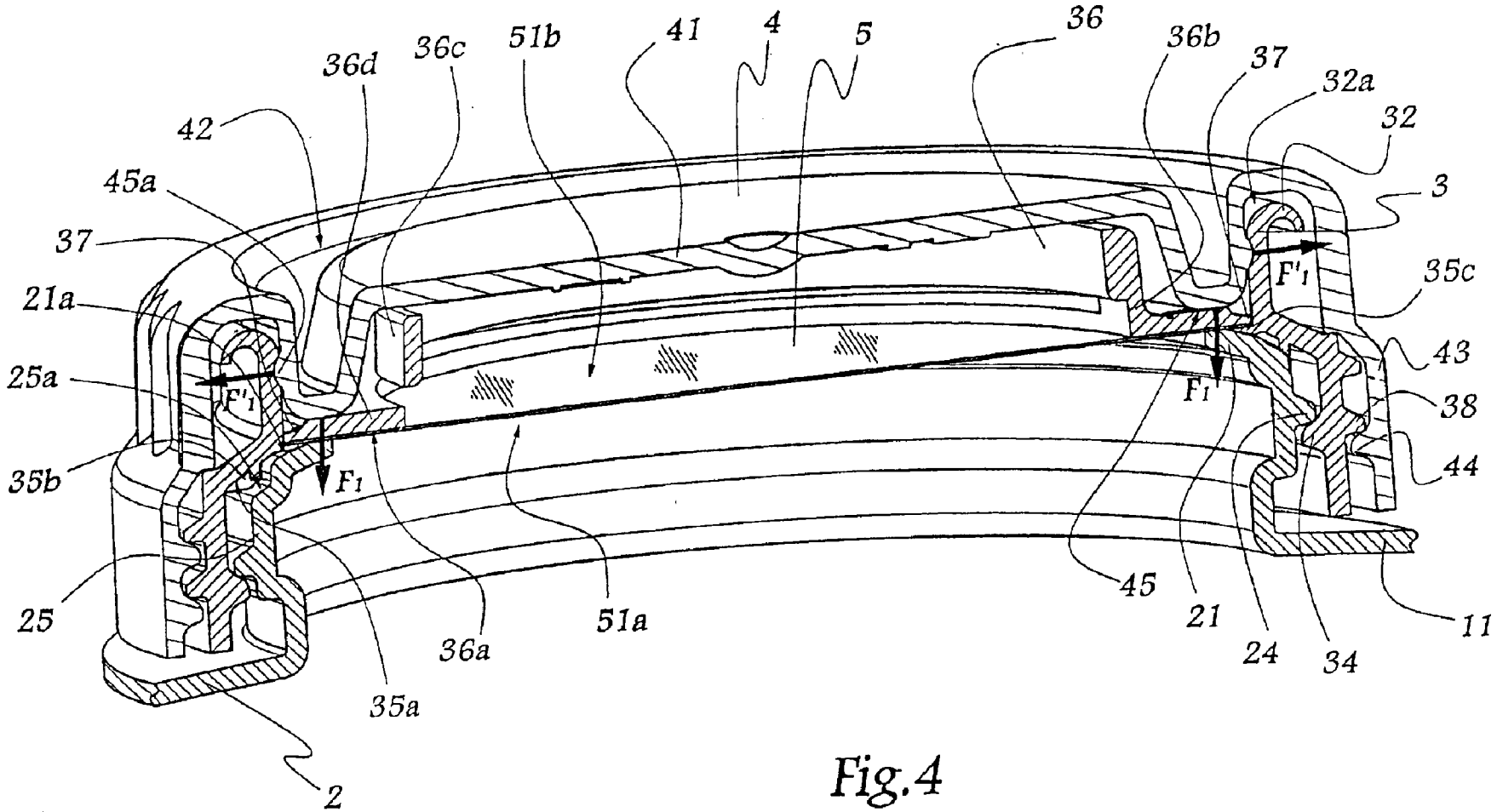
FIG. 4 is a section in perspective in the plane of section of FIG. 3 while the closure device is fixed on the bottle.

The part 35 is also bordered by a lip 35*c* provided to come into abutment against the surface 21*a*, as shown in FIG. 4, with the result that the risks of flow of milk between the neck 2 and the pourer 3 are eliminated.

In the proximity of the surface 31*a*, the part 31 is connected to an annular seal element 36 by means of eight breakable bridges 37. The seal element 36 forms, on its side oriented towards the lip 35*c*, a substantially planar annular surface 36*a* perpendicular to axis $X_3$-$X'_3$. The element 36 extends, opposite the surface the surface 36*a*, by a clip 36*b* from which extends a ring 36*c* for gripping configured so that a user can easily insert a finger.

The assembly of the elements 31 to 37 constitutes the pourer 3 which is in one piece, these elements being integral with one another during molding thereof.

The stopper 4 is also substantially cylindrical and $X_4$-$X'_4$ denotes its axis of symmetry. The stopper 4 comprises a principal plate 41 in which is made an annular depression or hollow 42 which is bordered by a skirt 43 of which the inner surface is provided with a thread 44 adapted to cooperate with an outer thread 38 formed radially outside the part 33 of the pourer 3.

The hollow 42 has a cross-section substantially in the form of a U and forms, seen from the inside of the stopper 4, a convex part 45 of central radius $R_{45}$ with respect to the axis $X_4$-$X'_4$ substantially equal to the mean radius $R_{36}$ of the annular surface of the element 36.

A membrane closure 5 is provided to be interposed between the neck 2 and the pourer 3 when the pourer is positioned on the neck. This membrane closure comprises a core 51 made of a sheet of a complex based on aluminium. This core is coated, on a first surface 51*a* intended to be in contact with the neck 2, with a layer 52 of peel-off varnish and, on its surface 51*b* opposite the surface 51*a*, with a film 53 of meltable polyethylene.

The radius $R_5$ of the membrane closure 5 is substantially equal to the maximum radius of the part 21 of the neck 2 and larger than the radii $R_{36}$ and $R_{45}$.

The closure device formed by elements 3 to 5 is pre-assembled before it is fixed on the neck 2. To that end, the membrane closure 5 is introduced in a pre-positioning chamber 39 of the pourer 3 which is defined between the surface 36*a* and the lip 35*c*.

The lip 35*c* therefore has a dual function, namely, on the one hand, the maintenance of the membrane closure 5 in the chamber 39 before the device formed by elements 3 to 5 is positioned on the neck 2 and, on the other hand, the tightness of the assembly between the pourer 3 and the neck 2.

Figure 3:
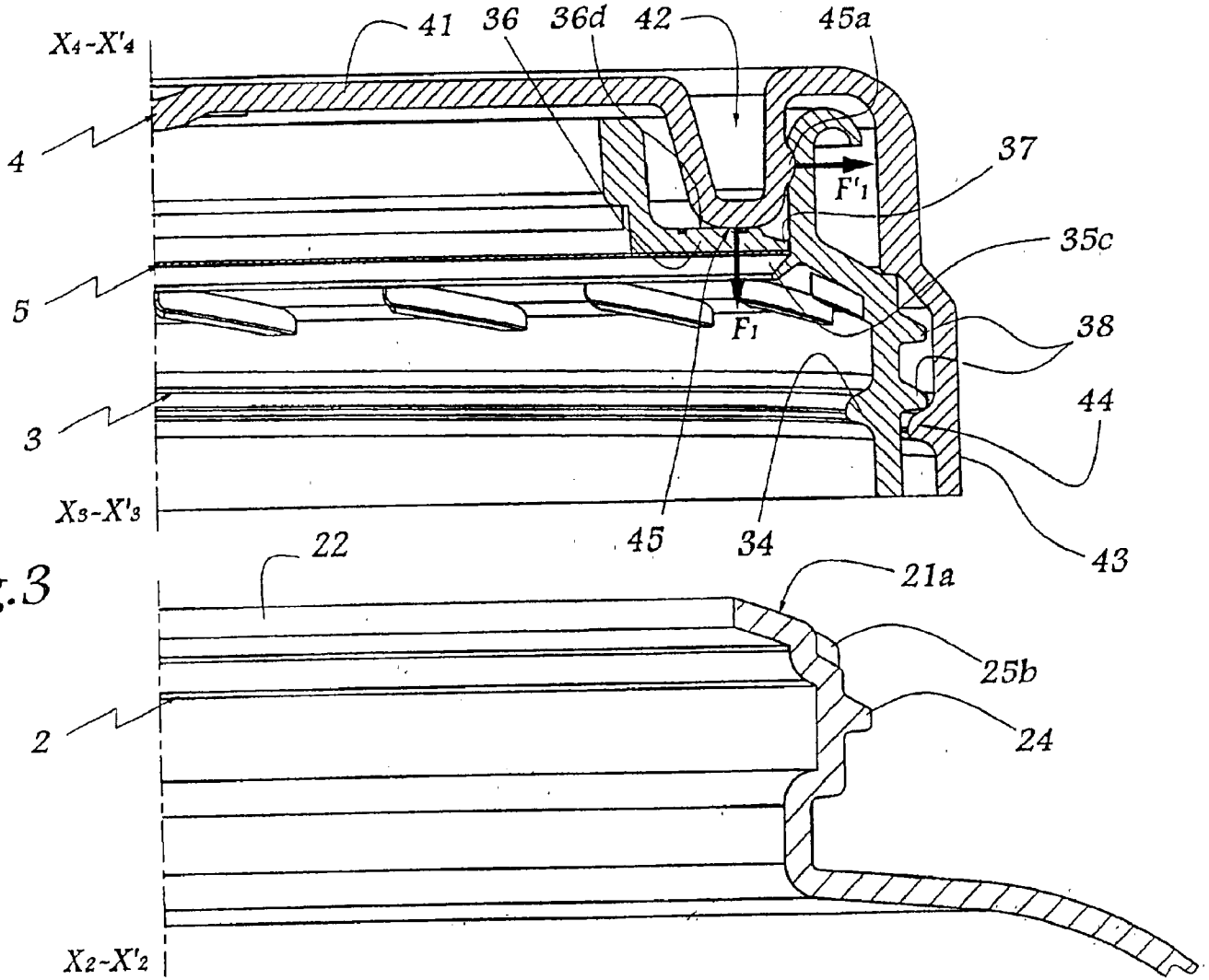
FIG. 3 is a half-section on a larger scale of the closure device of FIG. 1 in the course of fixation on the corresponding bottle.

After the membrane closure 5 has been positioned in the chamber 39, the stopper 4 is screwed on the pourer 3, by cooperation of the threads 44 and 38, which has the effect of breaking the bridges 37 and of pushing the member 36 in the direction of the lip 35*c*, as represented by arrow $F_1$ in FIG. 3, as the convex part 45 comes into abutment against the surface 36*d* of the element 36. The lip 35*c* in that case serves as stop for the movement of the element 36 and of the membrane closure 5 opposite the edge 32, the chamber 39 in that case being reduced between the surface 36*a* and the lip 35*c*.

At the end of pre-assembling, the closure device is in the configuration of FIG. 3 in which the element 36 is applied on the membrane closure 5 which is adjacent the lip 35*c*.

Due to the screwing of the stopper 4 on the pourer 3, a bead 45*a* formed on the outer surface of the part 45 is in abutment against the inner surface of the part 31 which it expands radially as represented by arrow $F'_1$, this inducing an additional locking of the stopper 4 on the pourer 3.

The pourer 3 may then be screwed on the neck 2 by the cooperation of the threads 24 and 34, which induces a firm abutment of the element 36 on the neck 2, with the interposition of the membrane closure 5, as shown in FIG. 4.

The upper part of the bottle 1 and the elements 3 to 5 are then subjected to a heating by induction, the heat easily propagating in the core 51 which is metallic. Such induction heating has the effect of melting the film 53, with the result that the element 36 is firmly sealed on the surface 51*b* of the membrane closure 5. This induction heating also has the effect of melting the layer 52 of peel-off varnish, the membrane closure 5 also being sealed on the surface 21. The bottle 1 is then hermetically closed.

The varnish constituting the layer 52 is chosen so that the fixation of the membrane closure 5 on the surface 21 is not definitive. This varnish may be of the type such as those used in the domain of the farm-produce industry for fixing covers on yoghurt pots.

Figure 5:
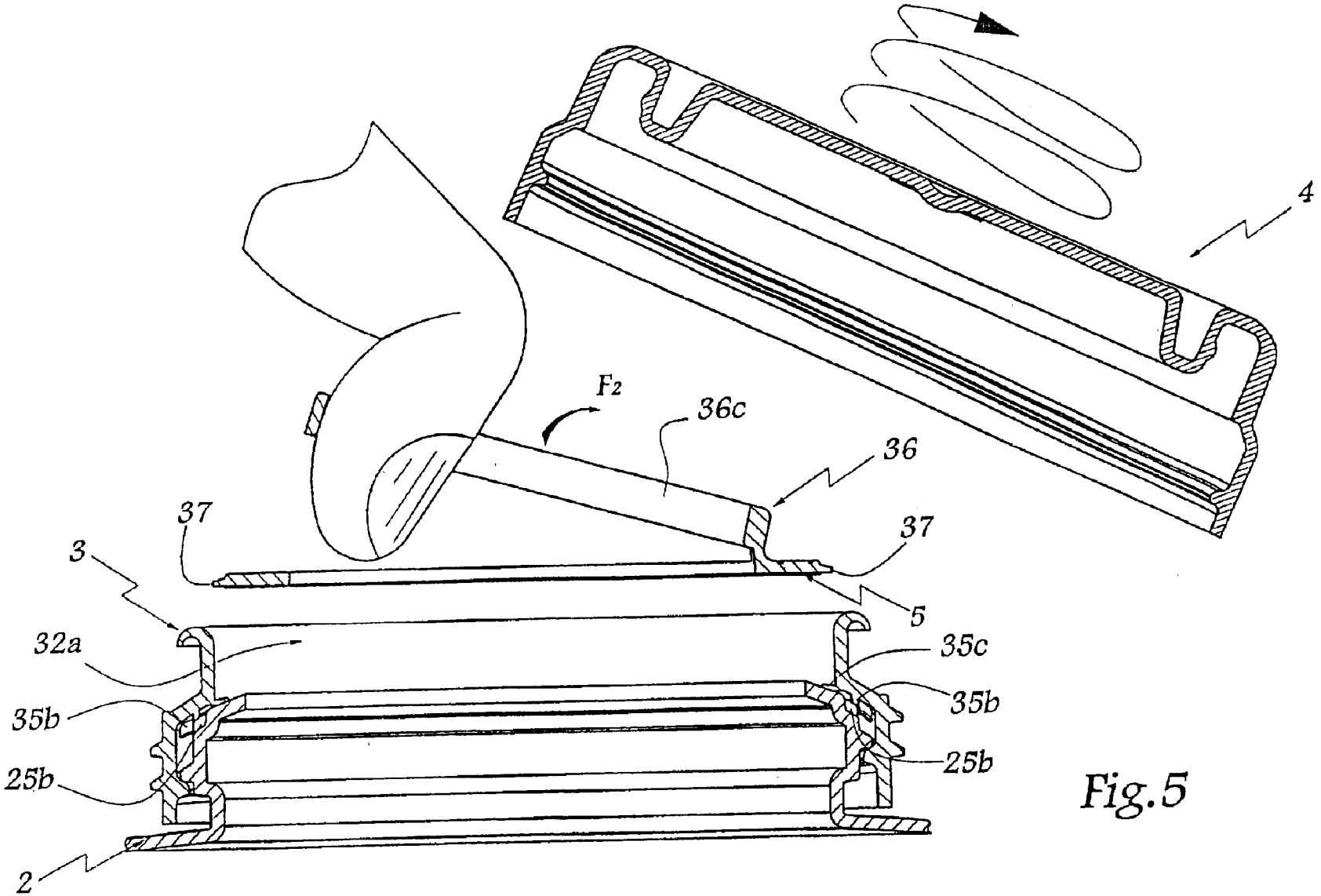
FIG. 5 is a section in the plane of FIG. 3 while the membrane for closing the neck is in the course of withdrawal.

When the milk contained in the bottle 1 is to be used, the user removes the stopper 4 by unscrewing it, which is natural. Just as naturally, he/she inserts his/her finger in the ring 36*c* and can pull thereon opposite the body 2 in an effort represented by arrow $F_2$ in FIG. 5, which has the effect of completely detaching the membrane closure 5 from the surface 21*a*, as this membrane closure is firmly sealed on the surface 36*a* while it is removably sealed on the surface 21*a*.

As a result, the assembly of the membrane closure 5 is effectively disconnected from the neck 2 without risk of tearing this closure, while the user does not have to search for a metallic tongue of difficult access in order to remove this closure.

The milk may thus flow over the surface 32*a* through the opening completely cleared by the membrane closure 5.

The invention has been described with a screwed pourer and stopper, but it is applicable with a clip-on pourer and/or stopper or with a stopper forming part of a hinge assembly.

According to a variant of the invention (not shown), the membrane closure 5 may be coated with peel-off varnish and film of glue solely at its edge 54, since the layers 52 and 53 are used only opposite the surfaces 21*a* and 36*a*. In addition, methods of sealing other than those envisaged hereinbefore may be employed for connecting the membrane closure 5 with the element 36 and/or the neck 2, particularly an adhesion of these elements or a superficial fusion of the element 36.

The invention has been shown when used for a bottle of milk. However, it is applicable to any recipient provided with a neck.

What is claimed is:

1. Device for closing a container provided with a neck, said device comprising a pourer (3) to be mounted on the neck and a cap (4) to be mounted over the neck and said pourer in a position to close the neck, an element (36) carried by said pourer and which moves within said pourer when urged by a force ($F_1$) applied in a direction of the neck when said cap is applied over the neck and said pourer, a membrane closure (5) carried by said pourer and including means to create a seal between said element and the neck, said cap (4) including a part (45) to engage against said element (36), and said pourer (3) being equipped with a lip (35*c*) defining, with said element (36), a pre-positioning chamber (39) for seating said membrane closure.

2. Device according to claim 1, wherein said element (36) includes a ring (36*c*) for gripping, whereby a force ($F_2$) applied to said ring causes said element and said membrane closure to be removed from the neck.

3. Device according to claim 2, wherein said element (36) includes a substantially planar surface (36*a*), for abutment against said membrane closure (5).

4. Device according to claim 3, wherein said means to create said seal (5) includes a first firm seal (53) between said membrane closure and said element (36) and a second removable seal (52) between said membrane closure and the neck (2).

5. Device according to claim 4, wherein said membrane closure comprises a core (51) made of a complex based on aluminum and coated, on a first face (51*a*), with a peel-off varnish (52) and, on a second face (51*b*), with a polyethylene based film (53).

6. Device according to claim 5, wherein said element (36) is maintained at a distance from said membrane closure (5) within said pourer (3) before said cap (4) is placed on said pourer and the neck.

7. Device according to claim 6, wherein said element (36) is connected by at least one breakable bridge (37) to said pourer (3), said at least one bridge making it possible to maintain said element at said distance from said membrane closure (5).

8. A plastic container for liquids, the container comprising, a neck (2), a device for closing and sealing said neck, said device including a pourer (3) to be mounted on said neck and a cap (4) to be mounted over the neck and said pourer in a position to close neck, an element (36) carried by said pourer and which moves within said pourer when urged by a force ($F_1$) applied in a direction of said neck when said cap is applied over said neck and said pourer, and a membrane closure (5) carried by said pourer including means to seal said membrane closure to said element and to said neck, said cap (4) including a part (45) to engage against said element (36), and said pourer (3) being equipped with a lip (35*c*) defining, with said element (36), a pre-positioning chamber (39) for seating said membrane closure.

* * * * *